US006697031B2

(12) United States Patent
Jocher

(10) Patent No.: US 6,697,031 B2
(45) Date of Patent: Feb. 24, 2004

(54) ANTENNA

(76) Inventor: Ronald W. Jocher, 24 Park Ter., East Hanover, NJ (US) 07936

( * ) Notice: Subject to any disclaimer, the term of this patent is extended or adjusted under 35 U.S.C. 154(b) by 0 days.

(21) Appl. No.: 09/920,485

(22) Filed: Aug. 1, 2001

(65) Prior Publication Data

US 2003/0025642 A1 Feb. 6, 2003

(51) Int. Cl.[7] ..... H01Q 1/36
(52) U.S. Cl. ..... 343/895; 343/790
(58) Field of Search ..... 343/895, 830, 343/846, 773, 790, 861

(56) References Cited

U.S. PATENT DOCUMENTS

| | | | | | |
|---|---|---|---|---|---|
| 2,368,663 | A | | 2/1945 | Kandoian | 250/33 |
| 2,511,849 | A | | 6/1950 | Hilferty et al. | 250/33 |
| 3,787,865 | A | | 1/1974 | MacDowell et al. | 343/703 |
| 3,815,137 | A | * | 6/1974 | Kaegebein | 343/180 |
| 3,987,456 | A | * | 10/1976 | Gelin | 343/830 |
| 4,492,114 | A | * | 1/1985 | Yamanaka et al. | 73/117.3 |
| 4,633,203 | A | | 12/1986 | Nowak | 333/161 |
| 4,851,859 | A | * | 7/1989 | Rappaport | 343/790 |
| 4,957,456 | A | * | 9/1990 | Olson et al. | 439/578 |
| 6,081,169 | A | * | 6/2000 | Romerein et al. | 333/100 |
| 6,198,434 | B1 | * | 3/2001 | Martek et al. | 342/373 |

OTHER PUBLICATIONS

"Application Note 118, Frequently Asked Questions On: Controlled Impedance," Polar Instruments Web Page, pp. 1–3, Mar. 6, 2002, http://www.polarinstruments.com/support/cits/AP118.pdf.

Anritsu Corp. product brochure, "18 and 19 Series Precision Air Lines," Mar. 6, 2002, http://www1.anritsu.co.jp/MPB/products/pdf_e/B01E_18_19.pdf.

Maury Microwave Corporation web page, "High Precision/Reference Air Lines, Reference Air Lines," Mar. 6, 2002, pp. 1–2, http://www.maurymw.com//Prdln2/calktcmp/pg140/arlns2.htm.

Taylor Corp. web page, "Thruline Rf Directional Wattmeters, Model 43, Accessory Guide," Mar. 5, 2002, http://www.taylortransmitters.com/power%20meter.pdf.

http://www.microwave101.com/encyclopedia/phaseshifter-s.cfm.

http://www.spectrum–et.com/phase_shifters11.html.

J. Kornfeld, "Ein breitbandantenne vom Typ "Discone" für das VHF– and UHF–Gebiet", Apr. 15, 1963, vol. 40, No. 8, pp. 369–375.

* cited by examiner

*Primary Examiner*—James Clinger
(74) *Attorney, Agent, or Firm*—Eli Weiss

(57) ABSTRACT

A multi-band radial horn antenna is disclosed that has a precision 50 ohm feed air line to ensure a match to a 50 ohm transmission line. The feed probe of the antenna has a threaded section that allows the antenna to be tuned quickly and precise in the field to provide maximum antenna performance. Once adjusted, a small locking nut is tightened to retain the physical location position. The antenna is economical to build as it has only four major parts. In operation, the antenna was found to have a 1.15 to 1 Standing Wave Ratio, a decade of frequency bandwidth and a low angle of radiation.

21 Claims, 5 Drawing Sheets

ANTENNA

BACKGROUND OF THE INVENTION

1. Field of the Invention

This invention relates generally to high frequency antennas and more specifically to a modified biconical or Kandoian type antenna having a conical ground plane.

2. Description of the Related Art

Wireless to the home is an emerging technology that allows multi-service functions to be communicated to each individual house or building through the radio frequency (RF) spectrums. Several examples of services that can be provided are wireless television service, wireless telephone service, wireless internet communications, utility company service monitoring, etc. There is a large potential need for these types of services.

To satisfy this current need, service providers are starting to install optical fiber in the streets without connecting the fiber directly to the individual households and office buildings on the street. The final connection, that of running a link of optical fiber from the optical fiber in the street to each individual household and office building is being delayed because of the relatively high cost. Wireless to the home circumvents the need to have expensive terrestrial wire line services and substantially reduces system support and maintenance costs. The major criteria is to have a frequency spectrum bandwidth that approaches the optical fiber.

SUMMARY OF THE INVENTION

A multi-band radial horn antenna is disclosed that has a precision 50 ohm air feed line to ensure a correct impedance match between the 50 ohm transmission line and the antenna feed probe. The feed probe of the antenna has a threaded section that allows the antenna to be tuned quickly and precisely in the field to provide maximum antenna performance. Once adjusted, a small locking nut is tightened to retain the physical location position. The antenna is economical to build as it has only four major parts. In operation, the antenna was found to have a 1.15 to 1 Standing Wave Ratio, a decade of frequency bandwidth and a low angle of radiation pattern.

DETAILED DESCRIPTION OF THE PREFERRED EMBODIMENT

Figure 1:
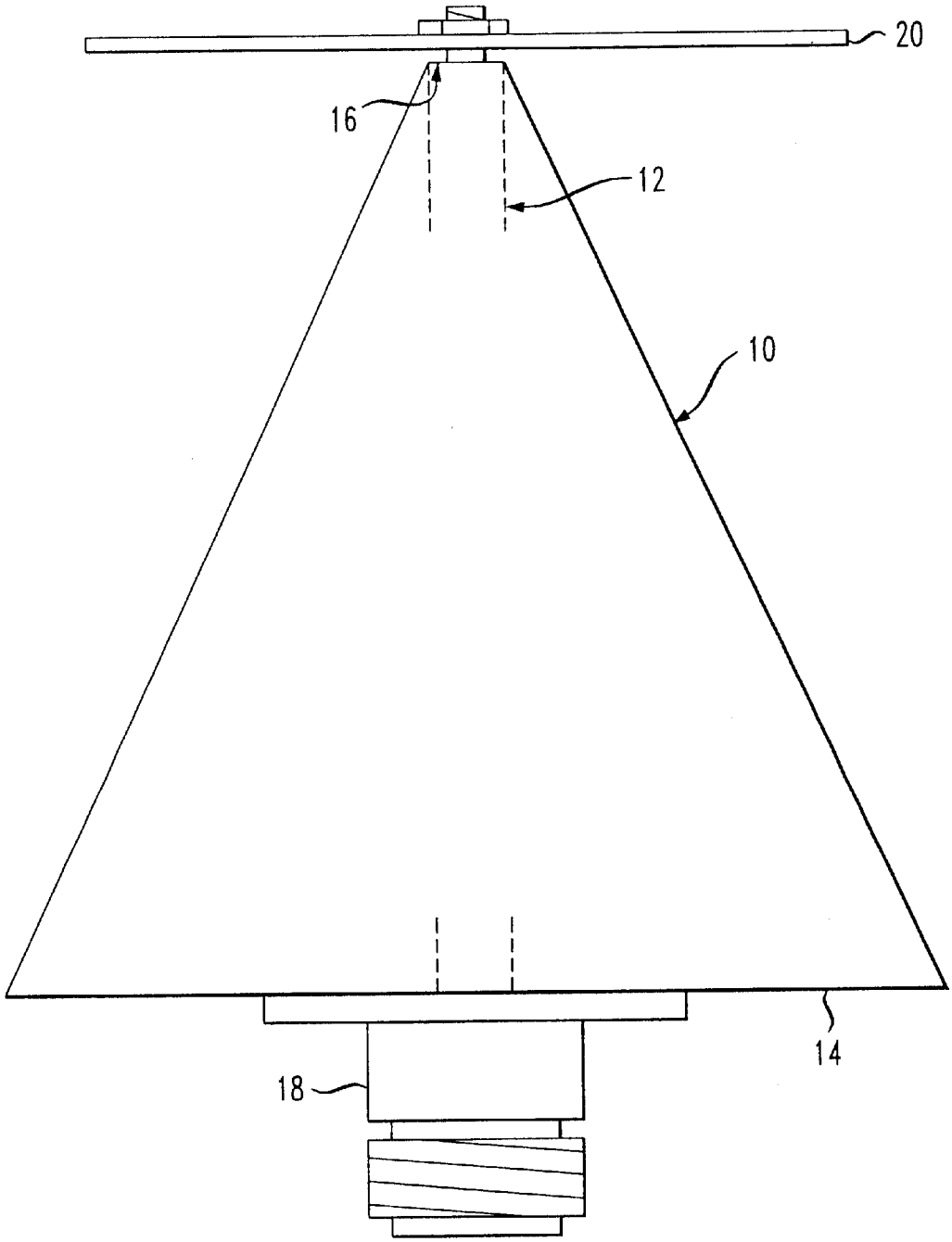
FIG. 1 is a side view of a multi band antenna in accordance with the principles of the invention.

Referring to FIG. 1, there is illustrated a disc-cone antenna that covers all three bands of the wireless spectrum; the cellular band, the PCS band, and the UMTS band. There would be one centrally located antenna on a tower to illuminate a specific targeted community that would communicate with each household containing a radial horn antenna. In the application of this invention to wireless technology, the optical fiber is connected to a central transmitting tower such as a wireless base station which has, as its antenna, the disc-cone antenna here disclosed. A second antenna of similar design is mounted to a household, office building or the like in the vicinity of the tower mounted antenna; and this second antenna is coupled to equipment located within the building. For each tower mounted antenna there are a plurality of building mounted antennas, where the number of building mounted antennas that receive the signals from a common tower mounted antenna is determined by the terrain of the area, the density of the buildings, the volume of traffic, etc.

The disc-cone antenna here disclosed is the ideal choice because it has the capability of covering a decade of frequency bandwidth and presents an excellent impedance match to a 50 ohm transmission line. The antenna has an omni-directional radiation pattern that circumvents the need of a field technician to bore sight the antenna to a specific radiation source. Additional features of low angle of radiation from the ground plane reference and excellent match to the transmission line ensure efficient antenna performance.

The disc-cone antenna is comprised of a conical member 10 having a fifty ohm air line 12 located within the cone. The conical member 10 or cone is composed of conducting material such as aluminum and the air line consists of a tubular passageway which extends through the cone from the base 14 to the apex 16. Located within the tubular passageway is a rod of conductive material. The rod of conductive material partially fills the tubular passageway and the space between the rod of conductive material and the tubular passageway is filled with air, a material that has a dielectric constant of substantially one. One end of the air line is connected to a coaxial connector 18 and the other end or feed is connected to a disc 20 positioned adjacent to the apex 16 of the cone. The body of the co-axial connector is connected to the cone by screws, and the rod within the tubular passageway is connected to the center conductor of the coaxial connector.

Figure 2:
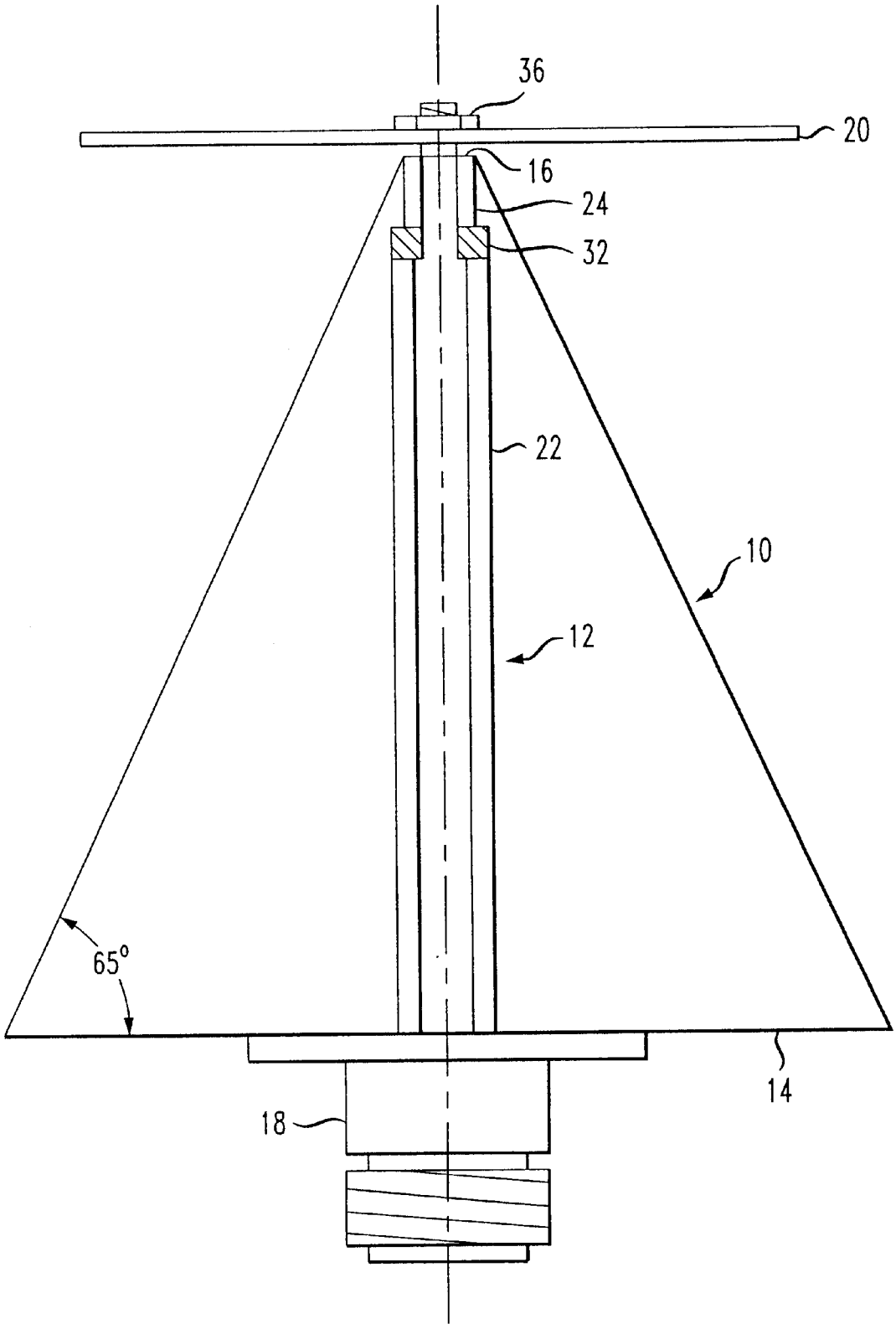
FIG. 2 is a cross sectional view of the antenna of FIG. 1.

Referring to FIG. 2, there is illustrated a cross sectional view of the disc-cone antenna of FIG. 1. The air line 12 is essentially a tubular channel opened to the atmosphere and which extends from the base 14 of the cone 10 to the apex 16. The channel has a first section 22 with a diameter of substantially 0.288 in. and a second section 23 with a diameter of substantially 0.186 in. The channel is centrally located within the cone. The cone can be composed of a conductive material such as aluminum or the like, or it can be made of a nonconductive plastic material that is coated on its outer surface and on the surface of the tubular passageway with a thin layer of conducting material. The conical cone illustrated has a base dimension or diameter of substantially 3.542 in.; a height dimension from base to apex of substantially 3.597 in.; and an angle formed by the base 14 and side of substantially 65 degrees. At the apex of the conical cone, the diameter of the second section 24 of the tubular passageway is substantially 0.186 in. and forms the feed point of the antenna.

Figure 3:
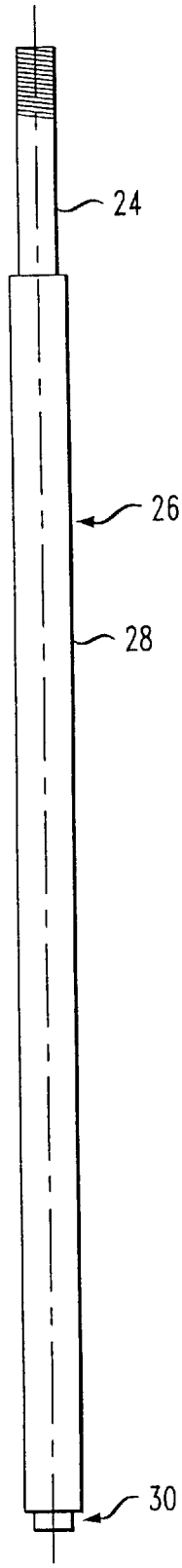
FIG. 3 is a view of the center conductor of the air line of the antenna of FIG. 1.

Referring to FIG. 3, there is illustrated the center conductor 26 of the air line 12. The center conductor is a rod of conductive material such as brass or the like. In the embodiment here disclosed, the rod is a 0.125 in. diameter brass rod. A first section 28 of center conductor 26 has a diameter of 0.125 in., and a length sized to fit within the first section 22 of the tubular passageway. A second section 24 of center conductor 26 has a diameter of substantially 0.082 in. and a length of substantially 0.546 in., which is sized to fit within the second section 24 of the passageway located adjacent the apex of the cone. The end of the second section 24 of the center conductor is threaded to receive a threaded member having a 2–56 thread size. The end 30 of the first section has a reduced diameter sized to be coupled to the center conductor of the co-axial connector 18. In the specific embodiment here described, the 2–56 threaded section extends back from the end of the center conductor for 0.162 in.; the second section 24 of the center conductor has a length of 0.546 in.; the reduced end 30 of the first section 28 has a diameter of 0.087 in. and a length of 0.0590 in.; and, the center conductor 26 has a total length of 3.560 in.

Figure 4:
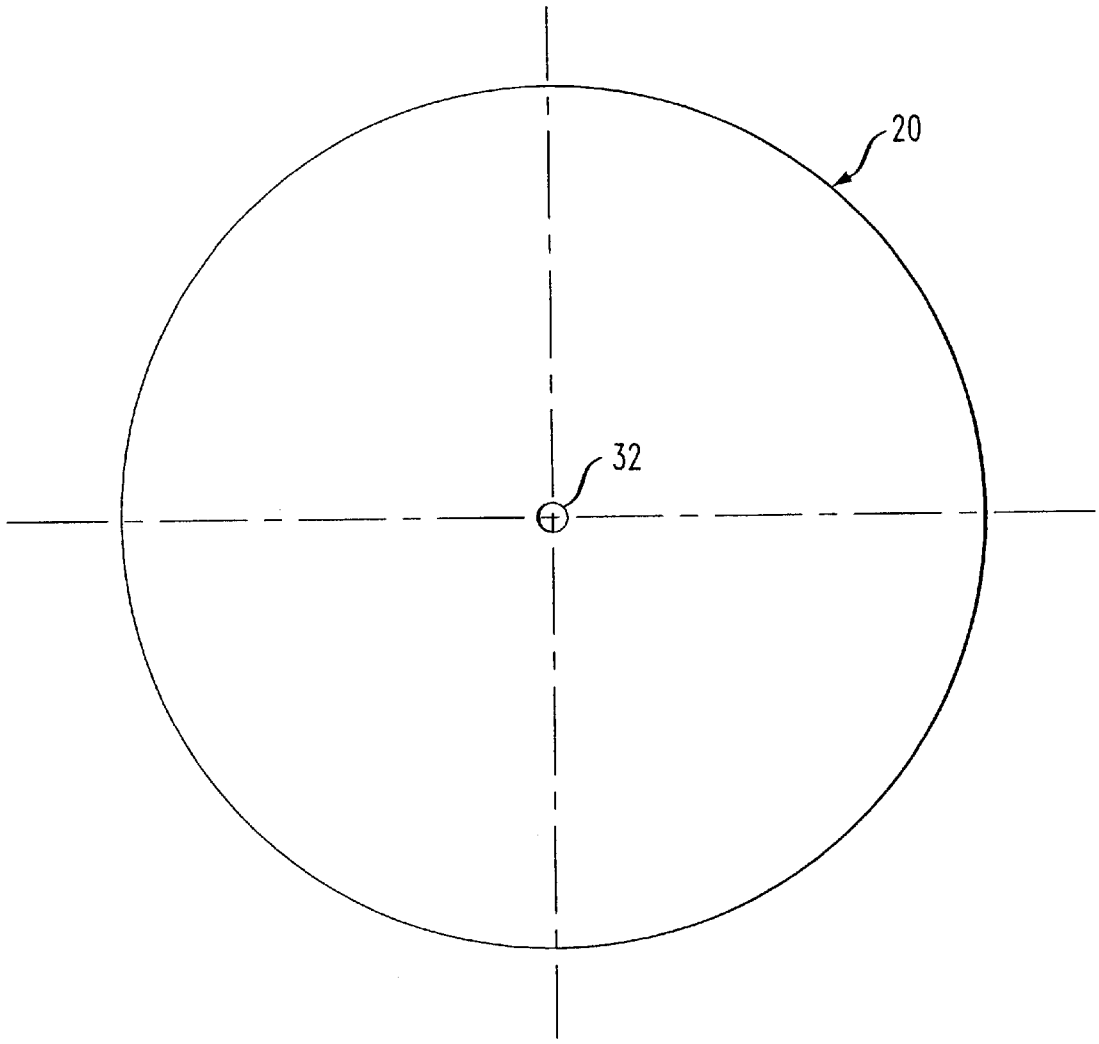
FIG. 4 is a plan view of the disc of the antenna of FIG. 1.

Referring to FIG. 4, there is illustrated a plan view of the disc 20 of the disc-cone antenna. The disc 20 is of a conducting material such as brass and has a diameter of 2.862 in. and a thickness of 0.063 in. The disc supports a centrally located opening 32 threaded to receive the threaded end of the center conductor 26.

When assembled, the center conductor resides within the tubular passageway. The lower end 30 of the center conductor is coupled to and held captive by the center pin of the co-axial connector 18; and the upper or second section 24 is engaged by a dielectric support washer 34 which axially aligns the center conductor with the tubular passageway. The threaded opening 32 engages the threaded end of the center conductor and is locked to a position which defines a desired spacing between the disk and the apex of the cone by means of a locking nut 36.

Figure 5:
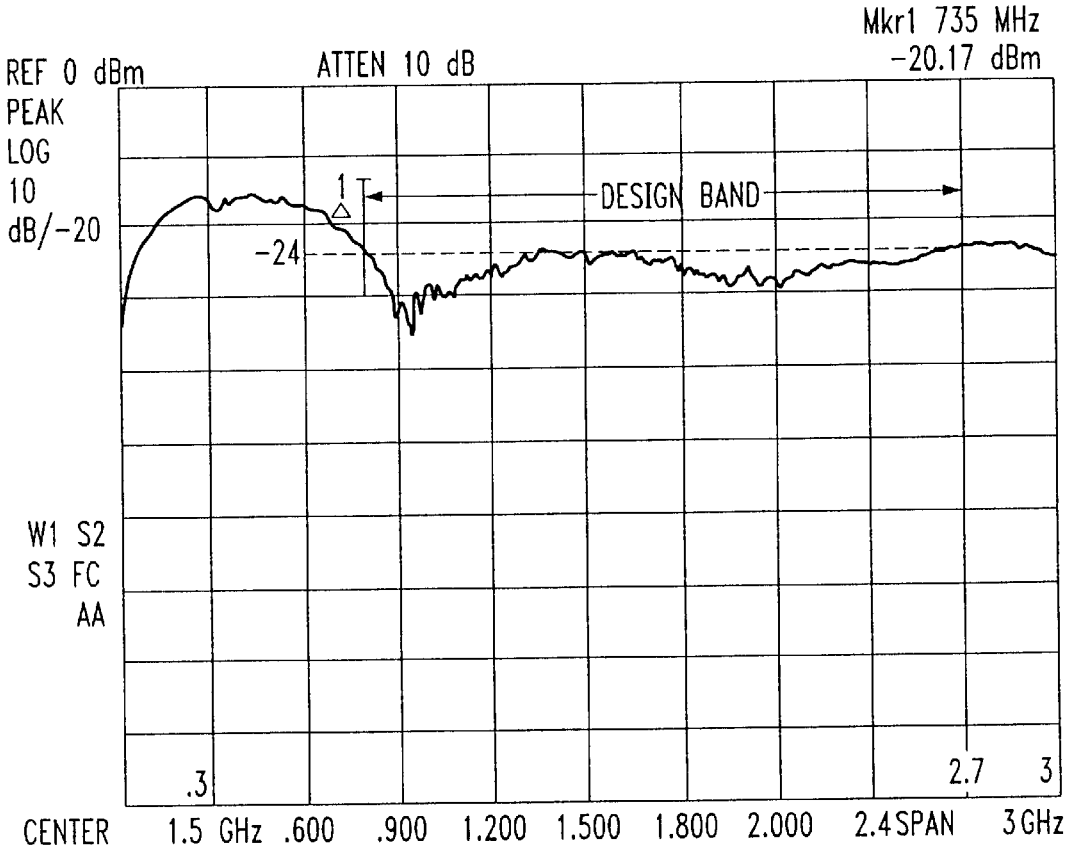
FIG. 5 is a plot of the input return loss of the antenna in dB Vs. frequency.

Referring to FIG. 5, there is illustrated a plot of the actual return loss of the disc-cone antenna here disclosed where the antenna input is matched to a 50 ohm transmission line. The results indicate that the disc-cone antenna can perform over the three bands of interest with an antenna Standing Wave Ratio that is better than 1.15 to 1.

In one embodiment of the operation of this invention where information is being transmitted from a base station tower to a household, the disc-cone antenna here disclosed is mounted to the tower located in an area surrounded by various households. Every household located proximate the tower mounted disc-cone antenna that contracts for service from the service provider of the tower mounted disc-cone antenna has a similar disc-cone antenna mounted to his/her household. The optical signals in the terrestrial optical fiber are converted to electrical signals at the base station, fed to the tower mounted antenna and transmitted to the surrounding households. The transmitted signals are received by the antennas on the households and are connected by the coaxial cable within the household directly to the customer's equipment. For the sending of information in the reverse direction, that is from the customer to the service provider, the electrical signals from the customer's equipment is transmitted from the customer's antenna to the service provider's tower mounted antenna. At the tower, the signals received are converted from the received electrical form into optical signals and fed to the optical fiber for transmission along the system.

The broad bandwidth performance characteristics of the disc-cone antenna here disclosed is ideal for coupling wireless to the home as it allows multi-service functions to be communicated to each individual household through the radio frequency spectrum. The antenna can cover a large frequency spectrum with the ability to include many service providers allotted frequency bands. It has an omnidirectional radiation pattern that can monitor several different transmission antenna locations without the need to change bore sight positions. It also has the potential to be manufactured at very low cost and offers excellent electrical performance characteristics.

While an embodiment of the invention has been described, it should be apparent that variations and alternative embodiments can be implemented in accordance with the principles of the invention. It is to be understood, therefore, that the invention is not to be in any way limited except in accordance with the spirit of the appended claims and their equivalents.

What is claimed is:

1. A method of transmitting signals, comprising the step of:

coupling a signal from a coaxial cable to an air line of a disc-cone antenna.

2. The method of claim 1 wherein the air line of the disc-cone antenna has a dielectric constant of substantially one.

3. The method of claim 1 where the impedance of the coaxial cable and the air line is substantially one.

4. The method of claim 1 wherein the impedance of the air line of the disc-cone antenna is substantially constant over the RF frequency range of 750 MHz to 7 GHz.

5. A method of transmitting signals comprising the step of:

transmitting from a disc-cone antenna having a 50 ohm air line, signals that lie between 750 MHz and 7 GHz received from a service provider.

6. A method of receiving a signal, comprising the step of:

using a disc-cone antenna having an air line to receive a signal; and coupling the signal from the air line to a coaxial line.

7. The method of claim 6 further comprising changing the space between the disc and the apex of the cone of the disc-cone antenna to tune the antenna by moving the disc along a threaded member.

8. The method of claim 7 wherein a first threaded member coupled to the cone is adapted to be engaged by a second threaded member coupled to the disc whereby the spacing between the disc and cone is changed to effect tuning by rotating the disc relative to the cone.

9. An antenna comprising a cone having a base and an apex, an air line extending through the cone from the base to the apex, and a disc coupled to the air line proximate the apex of the cone.

10. The antenna of claim 9 wherein the air line has a dielectric constant of substantially one.

11. The antenna of claim 10 wherein screw threads supported by the disc engage screw threads supported by the air line whereby rotation of the disc relative to the air line changes the spacing between the disc and the apex of the cone to control tuning of the antenna.

12. The antenna of claim 11 further comprising a connector coupled to the air line at the base of the cone for coupling RF signals to the air line.

13. The antenna of claim 12 wherein the connector is a coaxial connector wherein the center pin of the connector is couple to the air line and the body is coupled to the cone.

14. The antenna of claim 9 wherein the outer surface of the cone is conductive.

15. The antenna of claim 9 wherein the outer surface of the disc is conductive.

16. The antenna of claim 9 wherein the cone is composed of insulating material coated with conducting material.

17. The antenna of claim 10 wherein the air line comprises a conductive member that extends through a channel within the cone and where the wall of the channel is conductive.

18. A method of communicating an RF signal comprising the step of:

using an antenna with a 50 ohm air line.

19. The method of claim 18 further comprising the step of:

coupling the RF signal between a 50 ohm coaxial cable and the 50 ohm air line.

20. The method of claim 18, the method further comprising selecting the antenna for at least one of transmitting and receiving wireless signals.

21. An antenna comprising:

a feed element;

a coaxial connector structure; and an air line directly physically connected between said feed element and said coaxial connector structure.

* * * * *

UNITED STATES PATENT AND TRADEMARK OFFICE

CERTIFICATE OF CORRECTION

PATENT NO. : 6,697,031 B2
DATED : February 24, 2004
INVENTOR(S) : Ronald W. Jocher It is certified that error appears in the above-identified patent and that said Letters Patent is hereby corrected as shown below:

Title page,
Insert Item -- [73], Assignee, Lucent Technologies Inc., Murray Hill, N.J. --

Signed and Sealed this

Tenth Day of August, 2004

JON W. DUDAS
*Acting Director of the United States Patent and Trademark Office*